US005743752A

United States Patent [19]

Massebeuf

[11] Patent Number: 5,743,752

[45] Date of Patent: Apr. 28, 1998

[54] WATERPROOF ELECTRICAL CONNECTION APPARATUS

[75] Inventor: Eric Massebeuf, Rouen, France

[73] Assignee: Societe d'Exploitation des Procedes Marechal (SEPM), Saint Maurice, France

[21] Appl. No.: 565,152

[22] Filed: Nov. 30, 1995

[30] Foreign Application Priority Data

Dec. 2, 1994 [FR] France ..... 94 14515

[51] Int. Cl.[6] ..... H01R 13/44

[52] U.S. Cl. ..... 439/142; 220/242

[58] Field of Search ..... 439/142, 144; 220/242

[56] References Cited

U.S. PATENT DOCUMENTS

| | | | |
|---|---|---|---|
| 4,037,907 | 7/1977 | Klimek et al. | 439/142 |
| 4,058,358 | 11/1977 | Carlisle | 439/142 |
| 4,197,959 | 4/1980 | Kramer | 439/142 |
| 4,712,861 | 12/1987 | Lukas et al. | 439/142 |
| 5,080,601 | 1/1992 | Mennekes et al. | 439/314 |
| 5,545,046 | 8/1996 | Masuda et al. | 439/142 |

FOREIGN PATENT DOCUMENTS

| | | |
|---|---|---|
| 2551272 | 3/1985 | France . |
| 9217952 | 4/1993 | Germany . |
| 9302393 | 5/1993 | Germany . |
| 2061027 | 5/1981 | United Kingdom . |

*Primary Examiner*—Neil Abrams
*Assistant Examiner*—T. C. Patel
*Attorney, Agent, or Firm*—Greenblum & Bernstein, P.L.C.

[57] ABSTRACT

A waterproof electrical connection having a plug which is connected with a socket. The socket is provided with a casing having a hinged protective cover which is movable between an open position and a closed position. The socket can be an outlet or the connector of an extension lead of an appliance coupler. The casing has on its front edge an annular throat intended to receive an annular seal which extends from the throat in an axial direction. The cover and the plug have meeting surfaces intended to come into contact with the seal when the cover is in a closed position and when the plug is coupled to the socket.

22 Claims, 2 Drawing Sheets

WATERPROOF ELECTRICAL CONNECTION APPARATUS

BACKGROUND OF THE INVENTION

1. Field of the Invention

The present invention relates to a waterproof electrical connector. More particularly, the present invention relates to a waterproof electrical connector having plug which is connected with a socket and which constitutes the base of a plug and socket outlet or a connector of an extension cord or an appliance coupler.

2. Background Information

It is known to provide an socket constructed of a casing having a hinged protective cover. The socket generally is used as an outlet for an electrical connector. The cover swings from a closed position, sealing the connector, to an open position such that a plug can be inserted therein. The plug and socket each contain complementary contacts which, when coupled, form an electrical connection. It is also known to adapt such a socket to other systems of electrical connection by constructing a socket having complementary contacts to those of the plug. These systems include connectors for use in an electrical appliance coupler, and connectors for use with an extension cable.

However, it is difficult to design waterproof connector of this type which is capable of accommodating the play and tolerances between the various components of the plug and socket combination. Conventionally, a waterproof connector is obtained by using two flat annular seals. One seal is placed on the front edge of the socket. A corresponding seal is fitted on the cover and/or around a portion of the plug which contacts the socket.

Contrary to the prior art, it has been found that an effective waterproof seal can be formed using only a single seal arranged in the socket only. In this case, however, it is necessary to produce a water-tight seal for both the cover which has a pivoting movement, and the plug which has a translatory movement.

SUMMARY OF THE INVENTION

To achieve this end, according to the present invention, there is provided a waterproof electrical connection apparatus comprising a plug including a periphery and a contact surface formed around said periphery, a socket comprising a casing having an annular throat, an annular seal disposed within said annular throat, said annular seal projecting from said annular throat in an axial direction, and a protective cover connected to said socket by a hinge to pivotally move from a first position to a second position, said cover having a contact surface opposite said hinge. When said plug is coupled to said casing, said contact surface of said plug is arranged to contact said annular seal, and when said protective cover is in said second position and secured to said casing, said contact surface of said protective cover is arranged to contact said annular seal.

According to this embodiment, the electrical connection apparatus in which the socket casing has on its front edge an annular throat arranged to receive an annular seal which projects from the throat in an axial direction. The socket casing and the cover or the plug casing, respectively, present supporting surfaces which contact each other when the cover is in the closed position, or when the plug is in the coupled position to form a waterproof seal.

Preferably, the contact surface of said protective cover and said contact surface of said plug are annular tapered surfaces.

Additionally, the embodiment may further comprise a flat internal shoulder, which is contacted by a corresponding part of said protective cover when said protective cover is secured to said socket. In this case, the electrical connection apparatus according may have an exterior wall of said annular throat is extended relative to said flat interior shoulder of said throat. Further, the extension of said exterior wall of said annular throat widens out from back to front over at least the larger portion of its periphery allowing the seal to deform.

According to another embodiment of the present invention, the seal has a generally rectangular section tapered at its frontal extremity.

BRIEF DESCRIPTION OF THE DRAWINGS

The present invention is further described in the detailed description which follows, by reference to the noted drawings by way of a non-limiting example, in which the reference numerals represent similar parts throughout the several views, and wherein.

DETAILED DESCRIPTION OF THE PREFERRED EMBODIMENTS

Figure 1:
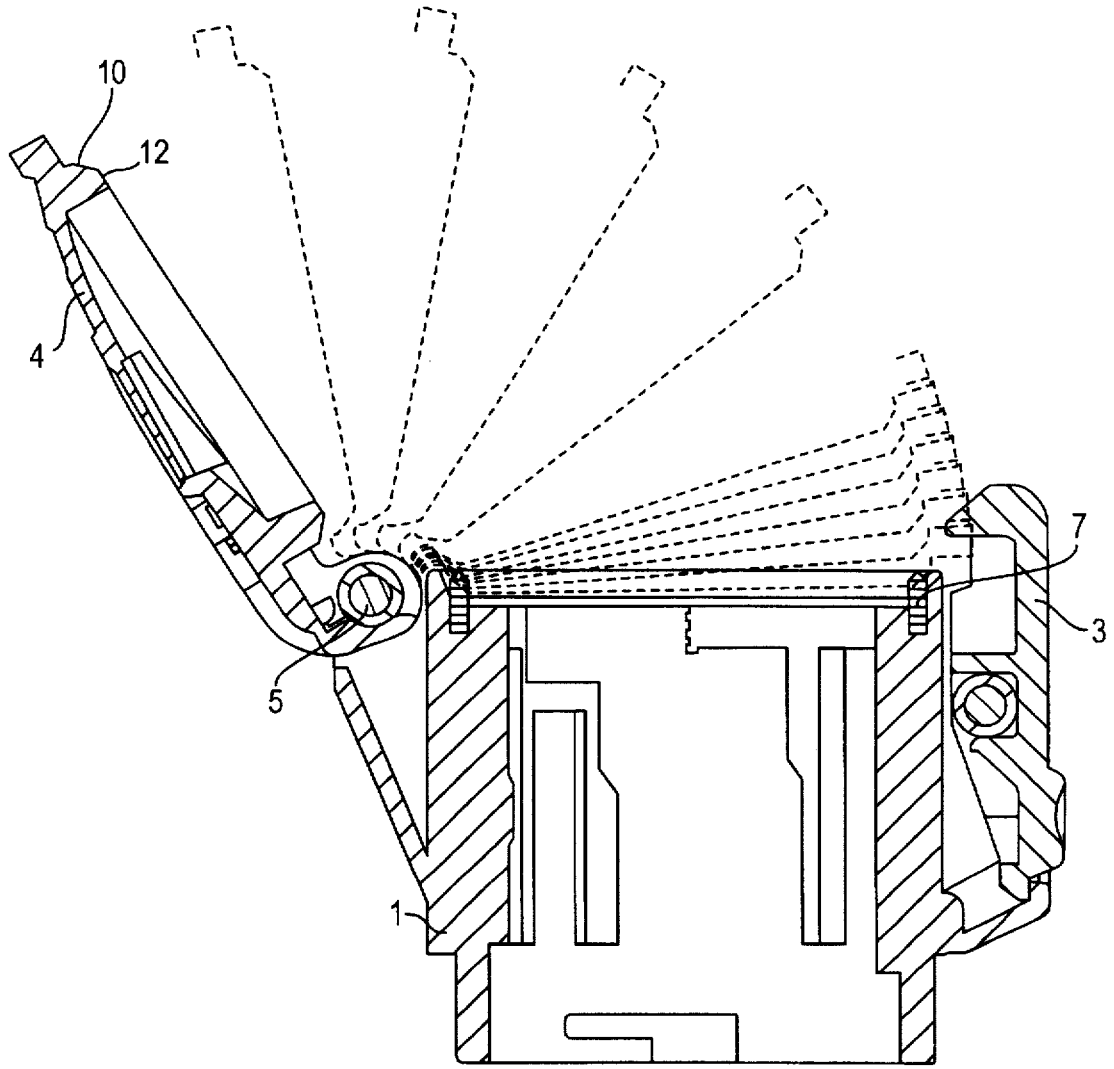
FIG. 1 shows in axial section the casing of a socket outlet provided with a cover and a locking hook.

Referring to the FIGS., an example of a socket outlet is illustrated. A socket casing 1, and a plug casing 2 which is inserted into, and connected to the socket casing 1 are shown. The socket casing 1 is also provided with a cover 4 which is hinged at a point 5 opposite a hook 3. At the frontal extremity of the socket casing 1 there is provided a throat 6 intended to receive an annular seal 7.

Within the plug casing 2 are provided multiple contacts in the form of pins which are intended to be plugged into corresponding contacts, generally under pressure, carried in an insulating support arranged in the socket casing 1 (the contacts do not form a part of the present invention, and are not shown). Because of the pressure exercised by the contacts and an ejection system of the plug, a locking mechanism is proved in the form of the hook 3 which is intended to cooperate with a corresponding part of the plug casing 2 in the connected position.

Figure 2:
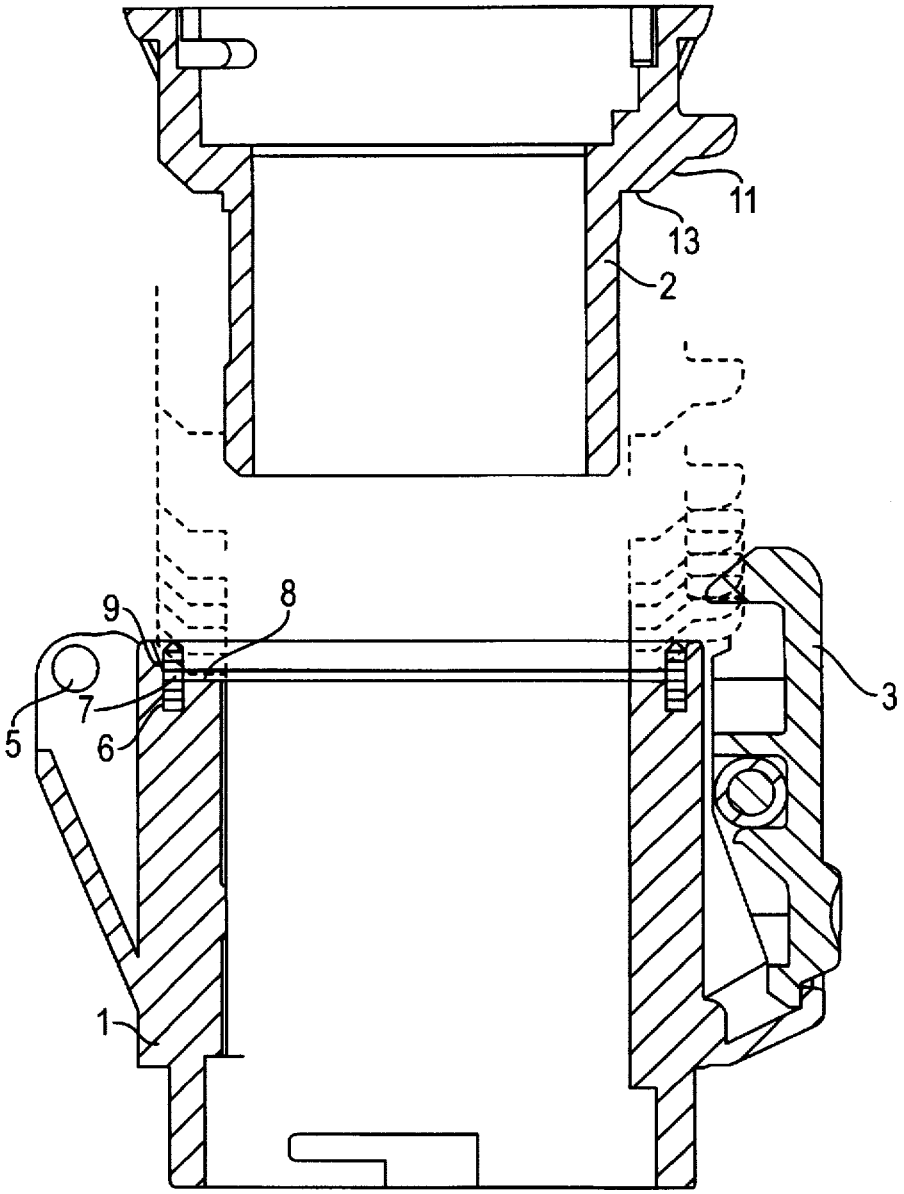
FIG. 2 shows the casing of the socket of FIG. 1 without a cover to simplify the drawing, as well as the plug casing in a position to be inserted therein.

The cover 4 is pivotally mounted as is shown in FIG. 1, and can be locked in the closed position by the hook 3, which is also intended to lock the plug 2 in the connected position as is described above. The rotation of the cover 4 is illustrated the various positions represented by broken lines in FIG. 1, and there is shown in the same way in FIG. 2, the approach and/or the engagement of the plug casing 2 in relation to the socket casing 1.

As is shown in the drawings, the throat 6 has a rectangular section with an internal flat shoulder 8 disposed in a plane perpendicular to the axis of the socket and an extension 9 of its exterior wall which widens out from the back towards the front. The extension 9 of the throat 6 has at one side of the casing a shape different from that at the other side. The different shape is for ease of manufacture. Preferably, a form of a majority of circumference of the throat 6, and its extension 9, in this embodiment is that represented at the side of the cover 4.

The seal 7 is inserted into the throat 6, and extends in a longitudinal direction in relation to the shoulder 8. As can be seen, the cross-section of the seal 7 is generally rectangular has at its extremity a double taper.

As the drawings clearly show, the cover 4 and the plug casing 2 each have a tapered annular surface 10 and 11, respectively, connected towards the interior by surfaces 12 and 13, respectively, arranged in a plane perpendicular to the axis of the cover and the plug. The tapered surfaces 10 and 11 converge towards the interior from back to front. It will be understood that the tapered surface 10 of the cover 4 comes in contact with the seal 7 commencing from the position of its hinge 5, while the tapered surface 11 of the plug casing 2 comes into contact peripherally of the interior surface of the seal 7. Also, as can be seen in the drawings and as indicated above, the annular seal can comprise the only seal on the casing, plug and cover, or that the annular seal can comprise a single seal arranged only in the socket.

In the closed position of the cover 4, or in the connected position of the plug casing 2, i.e., after locking by the hook 3, the tapered annular surfaces 10 and 11 of the cover 4 and of the plug casing 2 are pressed against the seal 7 which deforms towards the exterior due principally to the widening out of the extension 9 of the throat 6. The annular surfaces 12 and 13 of the cover 4 and the plug casing 2 come in contact with the shoulder 8 of the socket casing 1.

Even through the corresponding surfaces 10 and 11 and those of the seal 7 are shown as tapered surfaces, the seal 7 need not have tapers or can have a taper at one side only.

As stated above, the socket casing 1 may be that of an outlet, but also that of a connector provided for connection either to an appliance inlet or to the plug of a cable coupler.

While the invention has been described with reference to several exemplary embodiments, it is understood that the words with have been used herein are words of description and illustration, rather than words of limitation. Changes may be made, without departing from the scope and spirit of the invention in its aspects. The invention extends to all functionally equivalent structures, methods and uses, such as are within the scope of the appended claims.

This application is related to French Patent Application 9414515, filed Dec. 2, 1994, to which priority is claimed, and the entire disclosure of which is hereby incorporated by reference.

What is claimed:

1. A waterproof electrical connection apparatus, comprising:

a socket comprising a casing having an annular throat, said annular throat comprising a flat internal shoulder;

an annular seal disposed within said annular throat, said annular seal projecting from said annular throat in an axial direction;

a protective cover connected to said socket by a hinge to pivotally move from a first position to a second position, said cover including a contact surface;

a plug including a periphery and a contact surface formed around said periphery, said plug being insertable into said socket to be coupled in said casing; and when said protective cover is in said second position and secured to said casing, said contact surface of said protective cover is arranged to contact said annular seal and said flat internal shoulder is contacted by a corresponding part of said protective cover, and when said plug is coupled to said casing, said contact surface of said plug is arranged to contact said annular seal.

2. The electrical connection apparatus according to claim 1, wherein said annular seal has a generally rectangular section tapered at its front edge.

3. The electrical connection apparatus according to claim 1, wherein said annular seal has a generally rectangular section tapered at its front edge.

4. The electrical connection apparatus according to claim 1, said annular seal comprising the only seal on said casing, plug and cover.

5. The electrical connection apparatus according to claim 1, said annular seal comprises a single seal arranged only in said socket.

6. The electrical connection apparatus according to claim 1, said annular throat further comprises a flat internal shoulder, said flat internal shoulder contacted by a corresponding part of said plug when said plug is coupled to said socket.

7. The electrical connection apparatus according to claim 1, wherein said contact surface of said protective cover and said contact surface of said plug are annular tapered surfaces.

8. The electrical connection apparatus according to claim 7, wherein said annular seal has a generally rectangular section tapered at its front edge.

9. The electrical connection apparatus according to claim 1, wherein said annular throat has a rectangular section.

10. The electrical connection apparatus according to claim 9, wherein said annular seal has a generally rectangular section tapered at its front edge.

11. The electrical connection apparatus according to claim 7, wherein said annular throat has a rectangular section.

12. The electrical connection apparatus according to claim 7, said annular throat further comprises a flat internal shoulder, said flat internal shoulder contacted by a corresponding part of said protective cover when said protective cover is secured to said socket.

13. The electrical connection apparatus according to claim 9, said annular throat further comprises a flat internal shoulder, said flat internal shoulder contacted by a corresponding part of said protective cover when said protective cover is secured to said socket.

14. The electrical connection apparatus according to claim 11, said annular throat further comprises a flat internal shoulder, said flat internal shoulder contacted by a corresponding part of said plug is coupled to said socket.

15. The electrical connection apparatus according to claim 1, wherein an exterior wall of said annular throat is extended relative to said flat interior shoulder of said throat.

16. The electrical connection apparatus according to claim 15, wherein the extension of said exterior wall of said annular throat widens out from back to front allowing the seal to deform.

17. The electrical connection apparatus according to claim 12, wherein an exterior wall of said annular throat is extended relative to said flat interior shoulder of said throat.

18. The electrical connection apparatus according to claim 17, wherein the extension of said exterior wall of said annular throat widens out from back to front allowing the seal to deform.

19. The electrical connection apparatus according to claim 13, wherein an exterior wall of said annular throat is extended relative to said flat interior shoulder of said throat.

20. The electrical connection apparatus according to claim 19, wherein the extension of said exterior wall of said annular throat widens out from back to front allowing the seal to deform.

21. The electrical connection apparatus according to claim 14, wherein an exterior wall of said annular throat is extended relative to said flat interior shoulder of said throat.

22. The electrical connection apparatus according to claim 21, wherein the extension of said exterior wall of said annular throat widens out from back to front allowing the seal to deform.

* * * * *